US008018394B2

(12) United States Patent
Conrad et al.

(10) Patent No.: US 8,018,394 B2
(45) Date of Patent: Sep. 13, 2011

(54) UHF DIGITAL BOOSTER KIT FOR A TELEVISION ANTENNA AND METHOD

(75) Inventors: Timothy John Conrad, Mount Pleasant, IA (US); Gail Edwin McCollum, Wapello, IA (US)

(73) Assignee: Winegard Company, Burlington, IA (US)

( * ) Notice: Subject to any disclaimer, the term of this patent is extended or adjusted under 35 U.S.C. 154(b) by 345 days.

(21) Appl. No.: 12/465,259

(22) Filed: May 13, 2009

(65) Prior Publication Data

US 2010/0117911 A1 May 13, 2010

Related U.S. Application Data

(60) Provisional application No. 61/113,765, filed on Nov. 12, 2008.

(51) Int. Cl.
*H01Q 1/12* (2006.01)

(52) U.S. Cl. ..... 343/878; 343/713; 343/815

(58) Field of Classification Search ..... 343/713, 343/878, 833, 815, 817, 818
See application file for complete search history.

(56) References Cited

U.S. PATENT DOCUMENTS

| | | | | |
|---|---|---|---|---|
| D209,969 | S | 1/1968 | Greenberg | |
| D210,025 | S | 1/1968 | Kleinberg et al. | |
| 3,790,950 | A | 2/1974 | Smith et al. | |
| 4,218,686 | A | 8/1980 | Blonder | |
| 5,262,793 | A | 11/1993 | Sperry | |
| 5,612,706 | A | 3/1997 | Podell | |
| D427,183 | S | 6/2000 | Chrisey et al. | |
| 6,154,180 | A | 11/2000 | Padrick | |
| 6,483,476 | B2 | 11/2002 | Cox | |
| D480,387 | S | 10/2003 | Burns | |
| D500,496 | S | 1/2005 | Sherwood | |
| 7,068,234 | B2 | 6/2006 | Sievenpiper | |
| 7,180,462 | B2 | 2/2007 | Kaneko et al. | |
| D546,323 | S | 7/2007 | Van Buren et al. | |
| D551,662 | S | 9/2007 | Buren et al. | |
| 7,286,097 | B1 | 10/2007 | Van Buren et al. | |
| 7,358,909 | B2 * | 4/2008 | Sherwood | 343/713 |
| 7,423,606 | B2 | 9/2008 | Knadle, Jr. et al. | |
| 7,911,406 | B2 * | 3/2011 | Eckwielen et al. | 343/833 |
| 2007/0262912 | A1 | 11/2007 | Eckwielen et al. | |
| 2008/0117111 | A1 * | 5/2008 | Ikeda et al. | 343/713 |

* cited by examiner

*Primary Examiner* — Tan Ho
(74) *Attorney, Agent, or Firm* — Dorr, Carson & Birney PC

(57) ABSTRACT

An aftermarket UHF parasitic antenna kit and method for a mobile television antenna includes: a base having an engagement surface and an extending boom; rivet holes in the engagement surface that correspond in size and location to a corresponding number of holes in the bottom of the mobile television antenna; push rivets that engage the rivet and bottom holes to hold the base to the bottom of the mobile television antenna; base foot holes in the engagement surface and boom; resilient base feet that engage the base foot holes; and at least one parasitic antenna element connected to the boom.

13 Claims, 10 Drawing Sheets

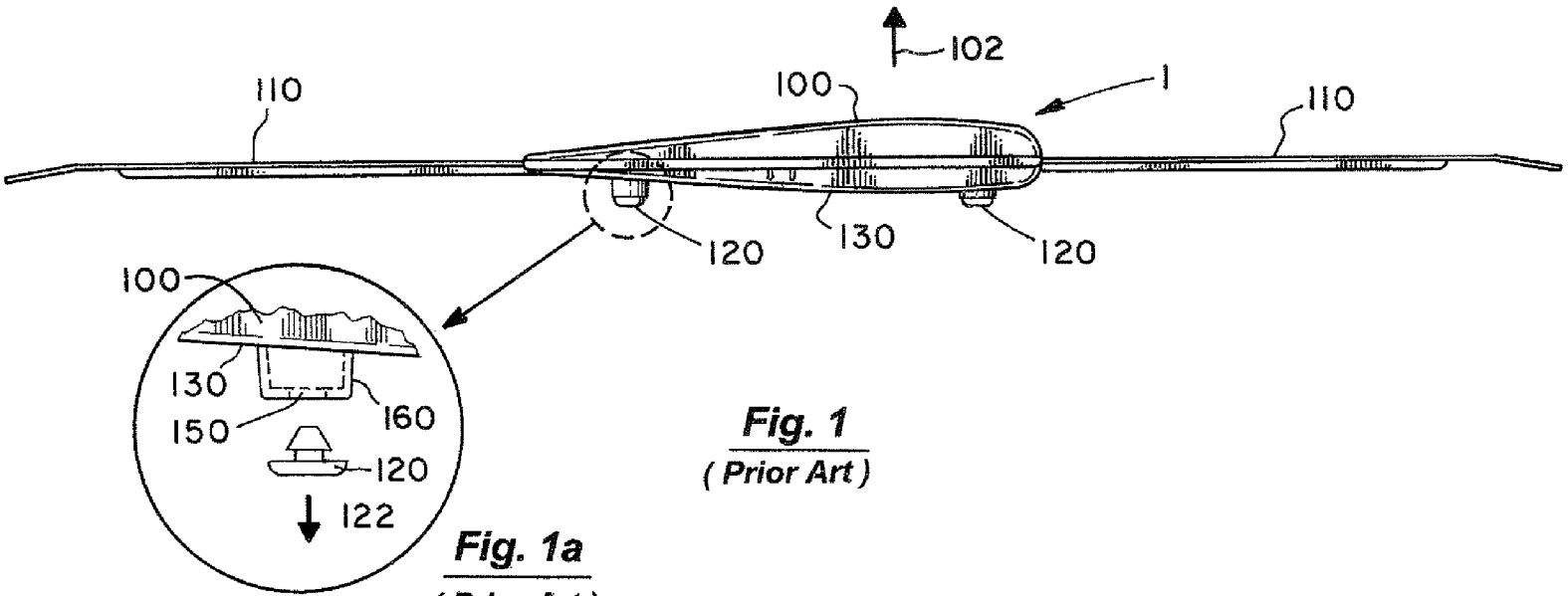
Fig. 1
(Prior Art)
Fig. 1a
(Prior Art)
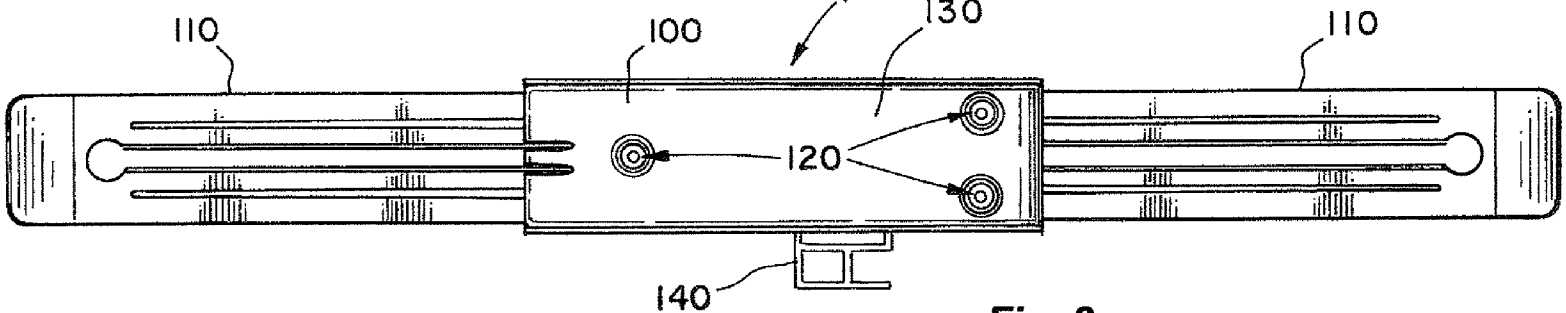
Fig. 2
(Prior Art)

UHF DIGITAL BOOSTER KIT FOR A TELEVISION ANTENNA AND METHOD

RELATED APPLICATIONS

This application claims the benefit of U.S. Provisional Patent Application Ser. No. 61/113,765 filed Nov. 12, 2008.

BACKGROUND OF THE INVENTION

1. Field of the Invention

The present invention relates to aerodynamic very high frequency/ultra high frequency (VHF/UHF) television antennas and, in particular, to such antennas having UHF parasitic elements to boost reception of high definition television broadcast signals.

2. Discussion of the Background

Conventional mobile VHF/UHF television antennas exist for use on vehicles such as recreational vehicles (RVs) and for residential use.

The popular SENSAR television antenna, manufactured by Winegard Co., provides VHF/UHF television reception when the RV is parked. In use, the SENSAR mobile television antenna which is mounted on the roof is raised, rotated and pointed to a desired TV station by an operator inside the parked RV to target incoming television signals. When not in use, as when the RV is travelling, the SENSAR antenna is stowed on the roof, is aerodynamic, and is stabilized against the roof to minimize vibration. Variations of the SENSAR antenna are shown in U.S. Pat. Nos. D500,496 S; 5,262,793 and 7,358,909.

High Definition Television (HDTV) signals are principally broadcast in the high VHF and UHF bands with some changes. The high VHF band remains at 174 to 216 MHz. The UHF band has changed to 470 to 698 MHz which is narrower than before. Most HDTV channels are carried in the UHF band.

A need exists to easily adapt UHF/VHF television antennas currently in use on roofs of vehicles or in residences by adding UHF parasitic antenna elements to boost HDTV UHF reception.

A need further exists to mount the UHF parasitic element without drilling additional holes in the current UHF/VHF television antenna.

A further need exists to provide an aftermarket add-on kit to existing mobile television antennas that can be easily installed.

A final need exists to provide a universal aftermarket add-on kit that retrofits different types and/or models of UHF/VHF television antennas.

SUMMARY OF THE INVENTION

A method for retrofitting the universal aftermarket UHF parasitic antenna kit to operate with the mobile television antenna meets the aforesaid needs. The operator removes existing resilient feet from foot holes in the bottom of the mobile television antenna. Rivet holes in the engagement surface of the base of the UHF parasitic antenna are then aligned over the foot holes in the bottom of the mobile television antenna. Rivets are then pushed-in by the operator into the aligned rivet and foot holes to attach the base of the UHF parasitic antenna to the mobile television antenna. The combined assembly is ready for operation.

An aftermarket UHF parasitic antenna kit for easily retrofitting to different types of mobile television antennas meets the aforesaid needs. The aftermarket kit includes: a base having an engagement surface and an extending boom portion; rivet holes in the engagement surface that correspond in size and location to a corresponding number of existing foot holes in the bottom of the mobile television antenna; push rivets that engage the rivet and bottom holes to hold the base to the bottom of the mobile television antenna. At least one UHF parasitic antenna element is connected to the boom portion for boosting reception of UHF broadcast signals by the mobile television antenna.

The aftermarket kit is universal in that the base portion has formed holes corresponding in size and location to bottom hole patterns of different types and/or models of mobile television antennas. The bottom hole patterns of each type corresponding to the pattern of holes receiving resilient feet.

The summary set forth above does not limit the teachings of the invention especially as to variations and other embodiments of the invention as more fully set out the following description taken in connection with the accompanying drawings.

BRIEF DESCRIPTION OF THE DRAWINGS

FIGS. 1 and 1*a* is a side elevation view of a PRIOR ART mobile television antenna.

FIG. 2 is a bottom elevation view of the PRIOR ART mobile television antenna of FIG. 1.

DETAILED DESCRIPTION OF THE INVENTION

Figure 3:
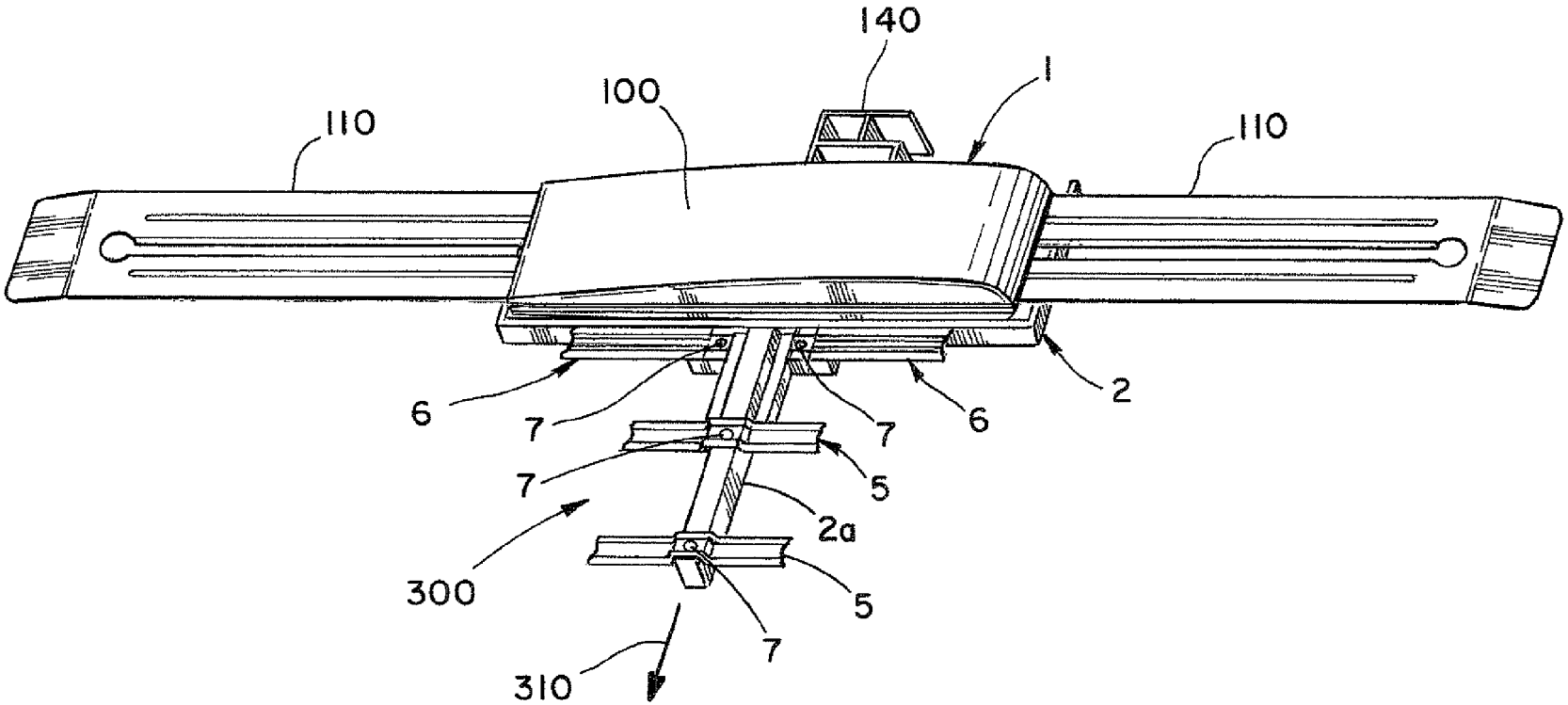
FIG. 3 is a perspective view of the mobile television antenna of FIGS. 1 and 2 retrofitted with the aftermarket UHF parasitic antenna of the invention.

In FIGS. 1 and 2, the prior art conventional SENSAR mobile television antenna 1 is shown to have a low profile, aerodynamic housing 100 with outwardly extending driven antenna elements 110. Three resilient base feet 120 such as "rubber" feet are inserted into the bottom 130 of the housing 1 and are used for stowing the mobile television antenna 1 on the roof of a vehicle such as a recreational vehicle. The term "rubber" is commonly used even though other materials such as neoprene are actually used. A block 140 connects the housing 100 to a support boom, not shown. U.S. Pat. No. 5,262,793, incorporated in its entirety herein by reference, discloses similar structure and different variations for the shape of the housing 100 and the number of resilient base feet 120 used for stowing the mobile television antenna 1 against the roof of a vehicle.

Figure 3A:
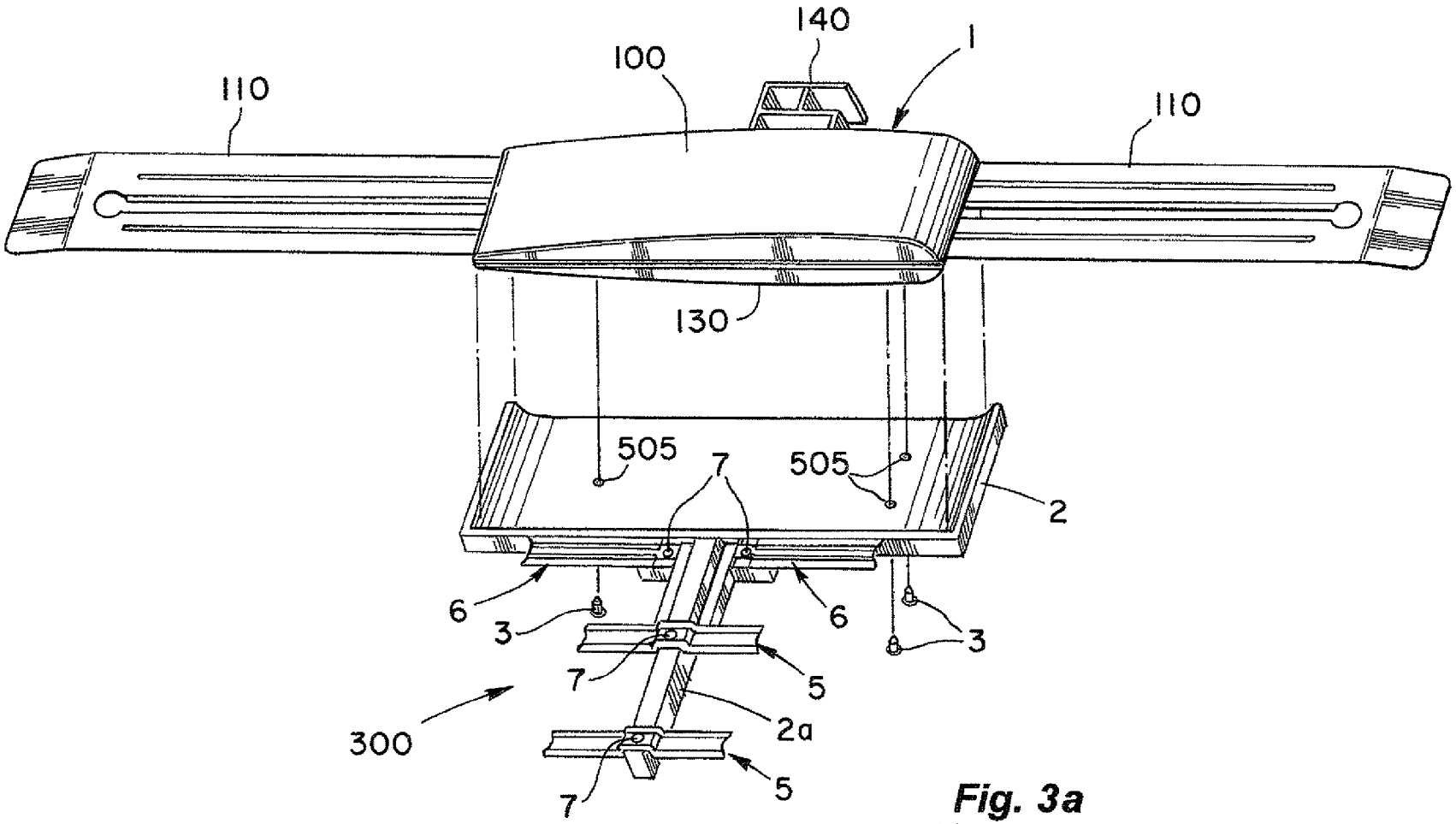
FIG. 3*a* is an exploded view of FIG. 3.
Figure 4:
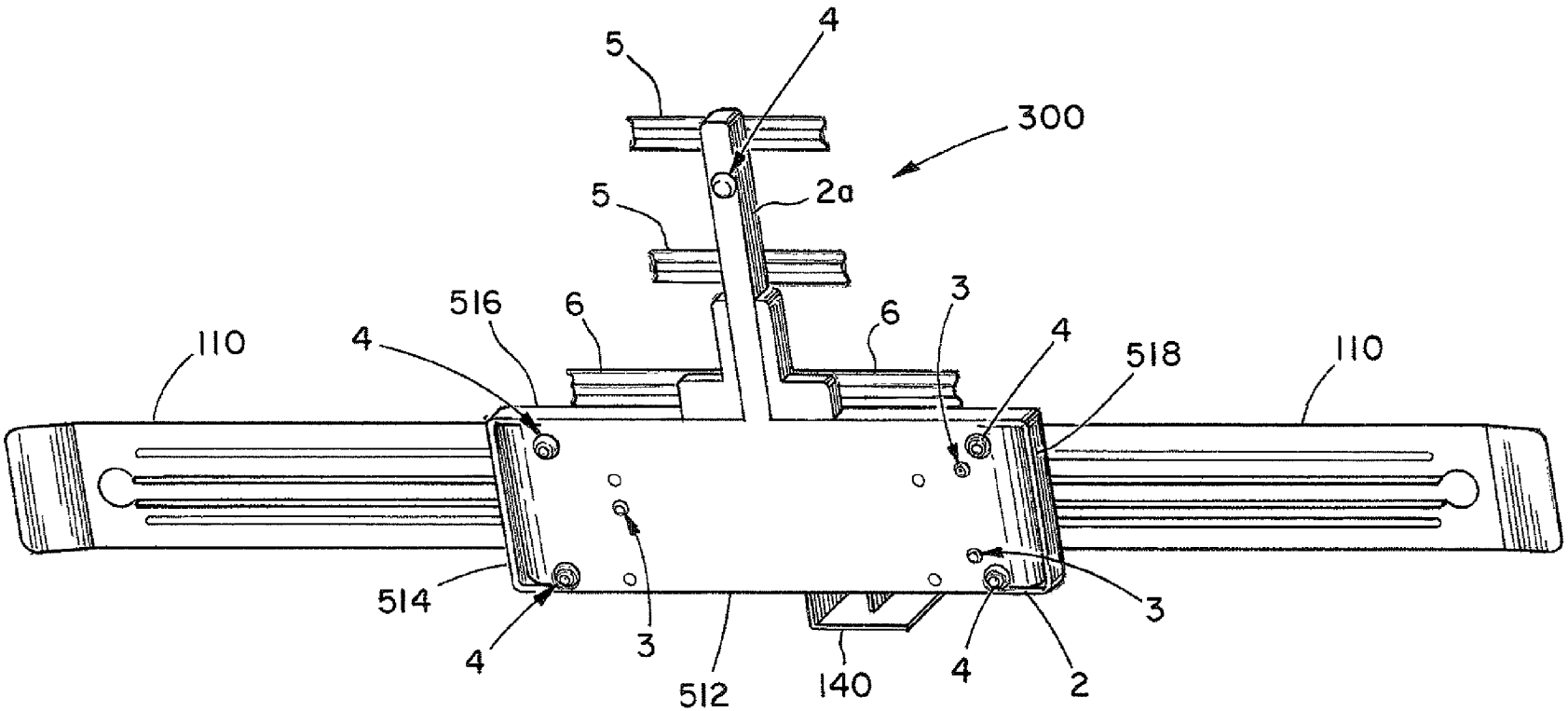
FIG. 4 is a bottom perspective view of the FIG. 3.

In FIGS. 3, 3*a* and 4, the aftermarket UHF parasitic antenna retrofit kit 300 of the invention is shown attached to the mobile television antenna 1. FIG. 3*a* is an exploded view of the attachment. The antenna retrofit kit 300 includes a molded plastic base 2 having an extending boom portion 2*a*, push rivets 3, resilient base feet 4, single UHF elements 5, double UHF elements 6 and rivets 7. As shown, base 2 is mounted to the bottom 130 of the mobile television antenna 1 with the UHF parasitic elements 5 and 6 on boom 2*a* pointing is a direction 310 away from block 140. The direction 310 with the antenna in use is towards the target broadcast television antenna or source of signal. The attached base 2 holds the UHF parasitic elements 5 and 6 as a director to increase UHF signal reception by the mobile antenna 1.

As shown in FIGS. 3 and 3*a*, two UHF parasitic elements 5 are attached to the boom 2*a* with two rivets 7 so that the UHF parasitic elements 5 are centered on the boom 2*a*. Two UHF parasitic elements 6 are attached to the boom 2*a* with two rivets 7. Any number of UHF parasitic elements 5 and 6 can be used to direct UHF signals to mobile antenna 1 in variations of the invention.

As shown in FIG. 4, five resilient base feet 4 are attached to the molded plastic base 2 (which includes the boom portion 2*a*). These five resilient base feet 4 substantially prevent damage to the vehicle roof and/or to the mobile television antenna 1 when the combined mobile television antenna 1 and retrofit kit 300 is stowed as discussed later.

Figure 14:
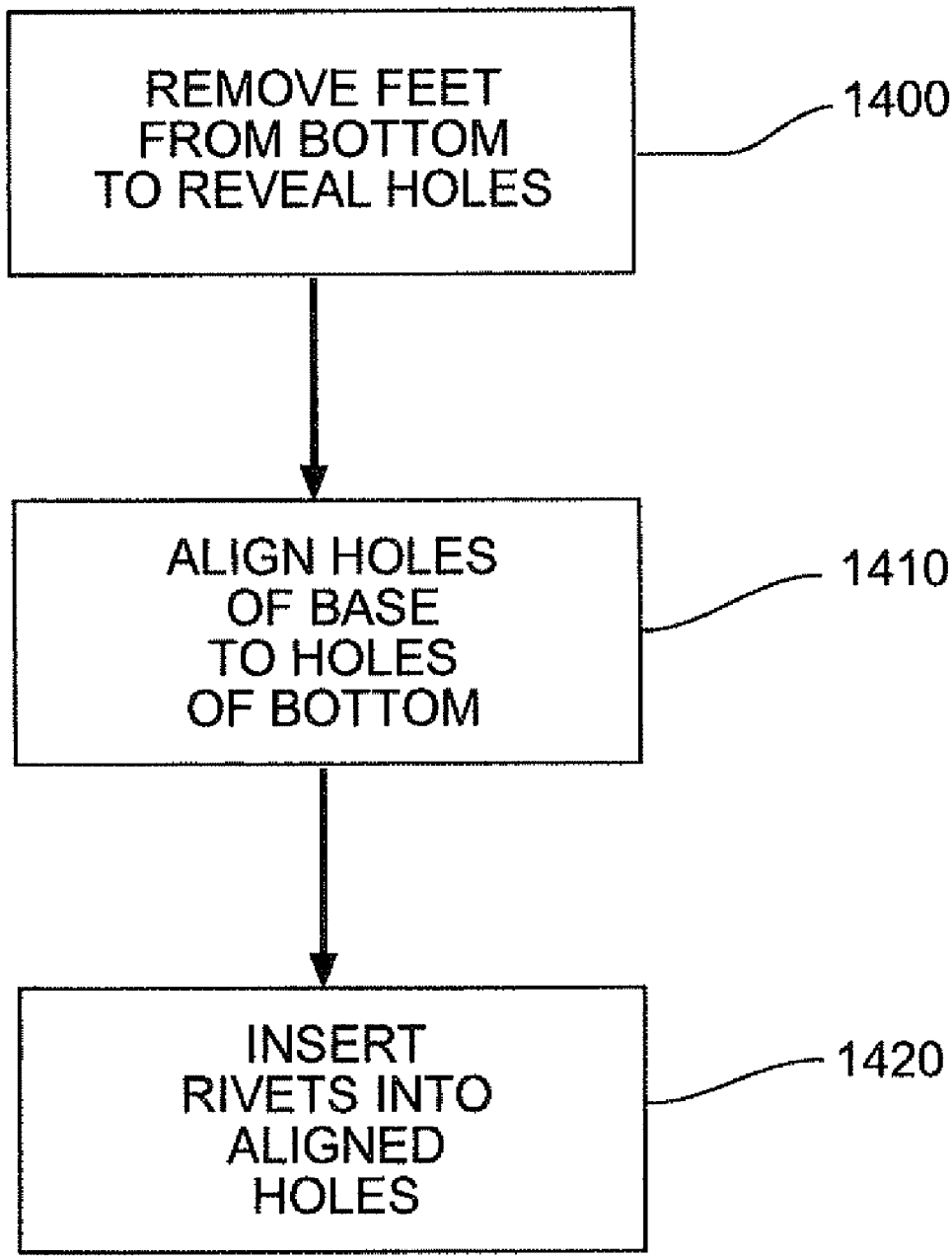
FIG. 14 sets forth a method of installing the universal aftermarket kit to the mobile television antenna.

The retrofit kit 300 is designed for ease of installation so that the operator can quickly and easily install the retrofit kit 300 to the existing mobile television antenna 1 on the roof of the vehicle without the use of tools or with minimal use of tools. The method for doing this shown in FIG. 14 occurs as follows. The mobile television antenna 1 is raised, as shown by arrow 102 in FIG. 1, to be off the roof of the vehicle. The existing resilient base feet 120 on the mobile television antenna 1 are removed in step 1400 to reveal foot holes 150 in the bottom 130 as shown in FIG. 1*a* by the operator pulling in the direction of arrow 122 with fingers or pliers. When each base foot 120 is removed, from the formed foot 160 of the bottom 130, a hole 150 is revealed. The bottom 130 may or may not have a formed foot 140. As shown is FIGS. 4 and 5, the base 2 is then placed up towards the bottom 130 of the mobile television antenna 1 with rivet holes 505 in the base 2 aligned with the revealed holes 150 in the bottom 130 as shown in step 1410. Three push rivets 3 (see FIGS. 9*a*, 9*b*, and 9*c*) are pushed-in by the operator through the rivet holes 505 of the base 2 to firmly hold the base 2 to the bottom 130 in foot holes 150 as shown in step 1420. The combined mobile television antenna 1 and the retrofit kit 300 is mounted and is ready for operation.

In summary, a method for retrofitting an UHF parasitic antenna 300 to operate with a mobile television antenna 1 has been set forth. The operator removes resilient base feet 120 from foot holes 150 in the bottom 130 of the mobile television antenna 1. The rivet holes 505 in the base 2 of the UHF parasitic antenna 300 are aligned over the revealed foot holes 150 in the bottom 130 of the mobile television antenna 1. The rivets 3 are inserted, by the operator pushing, into the aligned rivet and foot holes to attach the base 2 of the UHF parasitic antenna 300 to the mobile television antenna 1. The combined assembly is ready for operation.

In variations of the invention, use of common tools may be used such as pliers to assist in pulling out the feet 120. Or, in the case where the feet 120 are attached with screws through screw holes in the bottom, then a suitable tool can be used to remove the feet and the revealed screw hole used to receive the pushed in rivet. In another variation, the bottom 130 is conventionally mounted directly to the support used for raising and lowering the mobile antenna 1. In this variation, the antenna 1 is removed from the support and the base 2 with holes 505 formed and positioned to correspond to the connection between the bottom and the support permits the base 2 of the UHF parasitic antenna kit 300 to be held between the antenna 1 and the support. In all variations, base 2 of the parasitic antenna 300 is connected to existing holes in the bottom 130 of the mobile television antenna 1.

Figure 7:
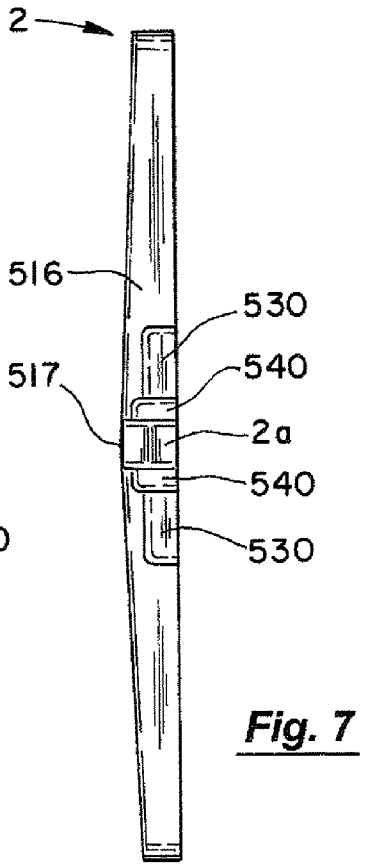
FIG. 7 is a view of the boom end of the base of the aftermarket UHF parasitic antenna of the invention.
Figure 5:
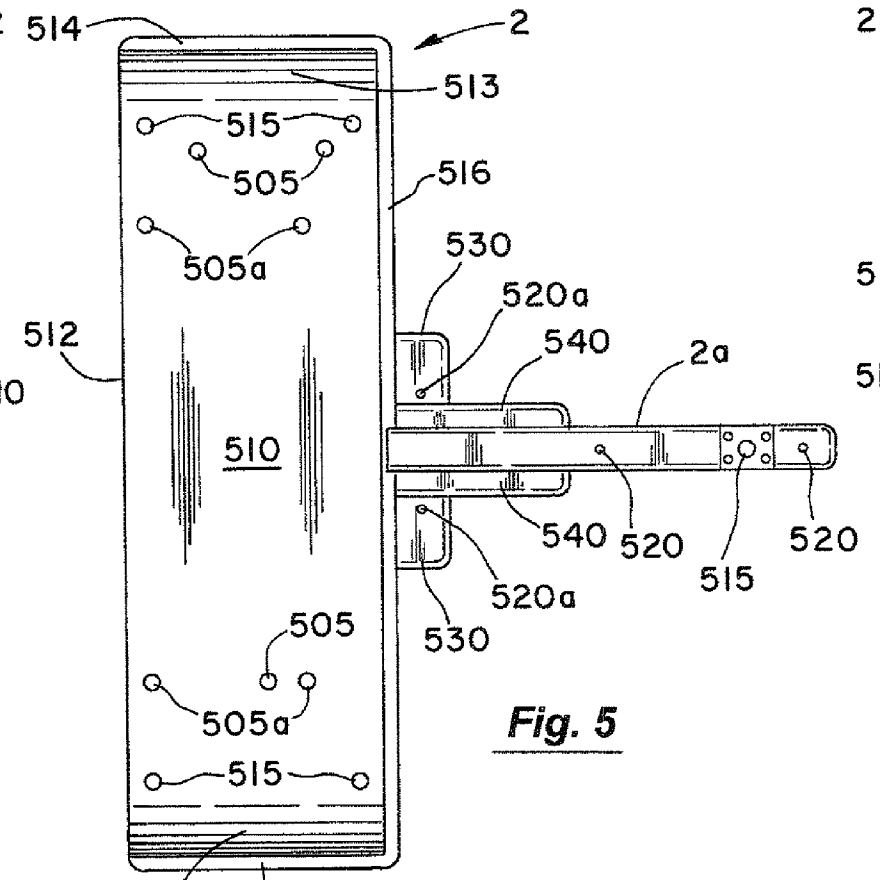
FIG. 5 is a top view of the base of the aftermarket UHF parasitic antenna of the invention.
Figure 8:
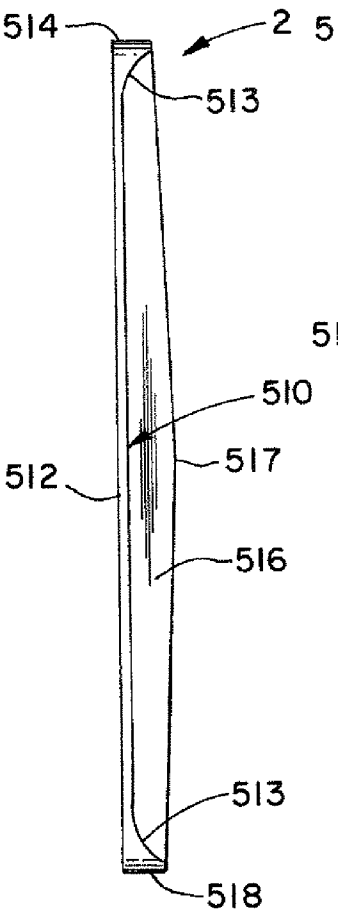
FIG. 8 is a view of the open end of the base of the aftermarket UHF parasitic antenna of the invention.

In FIGS. 5 through 8, the one-piece molded base 2 is shown with the extending boom portion 2*a*. In FIG. 5, three formed rivet holes 505 are shown that receive the three push rivets 3 as discussed above. Also shown are the five formed holes 515 which receive resilient base feet 4 as shown in FIG. 4. The base 2 has an engagement surface 510 which is open at end 512, curving 513 up into walls 514 and 518, and ending in wall 516. The top 517 of wall 516 slightly curves upward at the boom portion 2*a* as shown in FIGS. 7 and 8. The engagement surface 510 connects to the bottom 130 of the mobile television antenna 1 when the base 2 is attached with the push rivets 3. The three walls 514, 516, and 518 and the engagement surface 510 form a retention cavity for the housing 100 near the bottom 130. More or less than three walls can be used to form the retention cavity. The engagement surface 510 is configured and sized to generally mate with the bottom 130 of the mobile television antenna 1.

The pattern of three rivet holes 505 shown are sized and positioned in the engagement surface 510 to align with the pattern of three foot holes 150 in the bottom 130 of the mobile television antenna 1 The retrofit kit 300, however, is universal in that the kit can be retrofitted to more than one type of mobile satellite antenna 1 by providing more than one pattern of rivet holes 505 in the engagement surface 510. For example, FIG. 7 of the aforesaid U.S. Pat. No. 5,262,793 shows a pattern of four feet (and, thus four foot holes when the resilient feet are removed). As shown in FIG. 5, four rivet holes 505*a* correspond to the hole pattern of this type of antenna 1. FIG. 5 shows the engagement surface with two rivet hole patterns: one hole pattern is three rivet holes 505 corresponding to the mobile television antenna type/model having three bottom holes in the same pattern and one hole pattern is four rivet holes 505*a* corresponding to the mobile television type/model having four bottom holes in the same pattern. The engagement surface 510 can have a number of rivet hole patterns corresponding to a desired number of different types of mobile television antennas. The four rivet holes 505*a* are not shown in FIG. 3*a* for clarity purposes as the three rivet holes 505 are shown being aligned.

Figure 6:
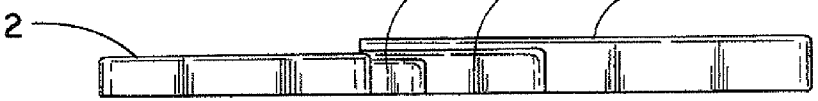
FIG. 6 is a side view of the base of the aftermarket UHF parasitic antenna of the invention.

The boom portion 2*a* extends outwardly as shown in FIGS. 5 through 7. Formed holes 520, 520*a* receive rivets 7 to firmly affix the UHF parasitic elements 5 and 6 perpendicular to the boom portion 2*a*. Each formed hole 515 receives a base foot 4. The boom portion 2*a* has a first structural support 530 on either side of the boom 2*a* for holding parasitic elements 6 and a second structural support 540 on either side of the boom for strengthening the boom. It is understood that different structural designs can be used for supports 530 and 540 and that the design and shape of the boom 2*a* can also vary under the teachings set forth herein. The boom 2*a* need not be integral and may be a separate structure connected to the base 2 in a variation.

Figure 9A:
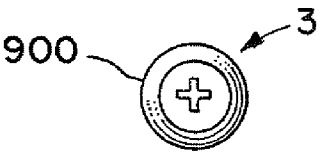
FIGS. 9*a*, 9*b*, and 9*c* are views of the push rivet.
Figure 9B:
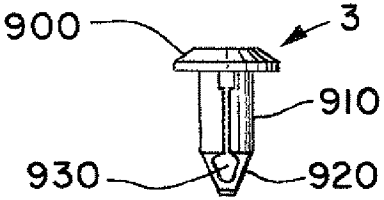
Figure 9C:
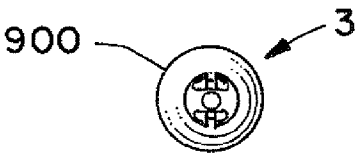

In FIGS. 9*a*, 9*b*, and 9*c*, the details of the push rivet 3 are set forth. Push rivets are conventional and available from different suppliers. The push rivet 3 has a head 900, a shank 910 and a pointed end 920. An internal cavity 930 exists to provide relief when pushed in.

Figure 10:
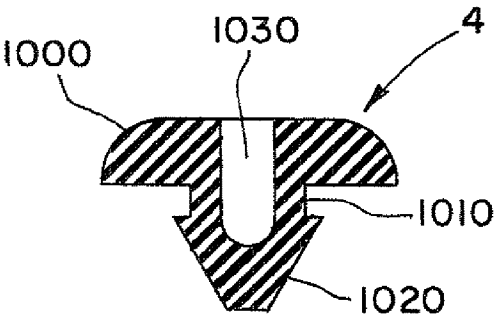
FIG. 10 is a view of the base resilient foot.

FIG. 10 is a cross-section of a conventionally available base foot 4 (also called a rubber foot) which is made of a resilient neoprene material. Base foot 4 has a foot 1000, a shank 1010, and a pointed end 1020. An internal cavity 1030 exists to provide relief when pushed in.

Figure 11B:
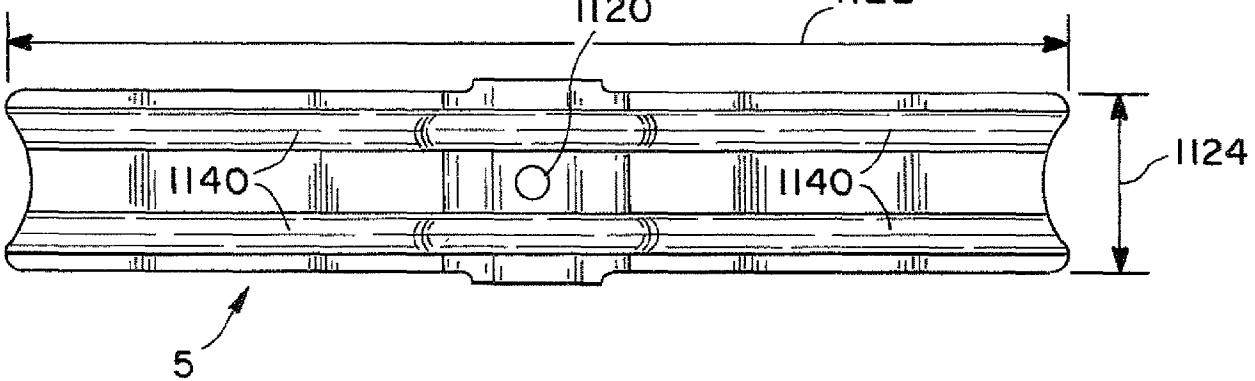
FIGS. 11*a*, 11*b*, and 11*c* are views of a single parasitic UHF antenna element.
Figure 11A:
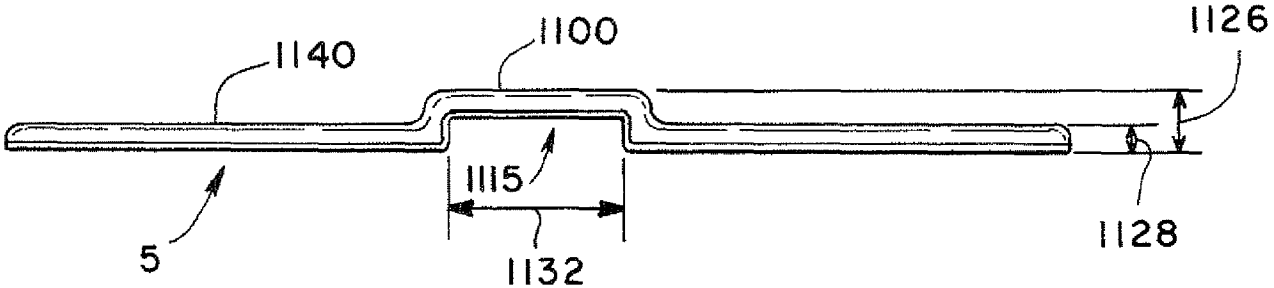
Figure 11C:
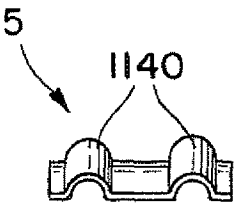

FIGS. 11*a*, 11*b*, and 11*c* show the details of the single UHF parasitic antenna elements 5 made from aluminum stock and coated with an iridite finish. The center portion 1100 is raised to form a cavity 1115 which mounts over the boom portion 2*a*. The formed hole 1120 on the center portion 1100 aligns over formed hole 520 in boom 2*a* so that a rivet 7 firmly secures the element 5 to the boom 2*a* through holes 1120 and 520. The shape of the element 5 can be of any suitable shape to act as a parasitic UHF antenna. The shape shown is aerodynamic and is provided with raised ridges 1140 that provide strength in wind and vibration. Dimensions for the embodiment shown are: length 1122 is 6.075 inches, length 1124 is 1.040 inches, length 1126 is 0.362 inches, length 1128 is 0.162 inches, and length 1132 is 1.000 inch.

Figure 12B:
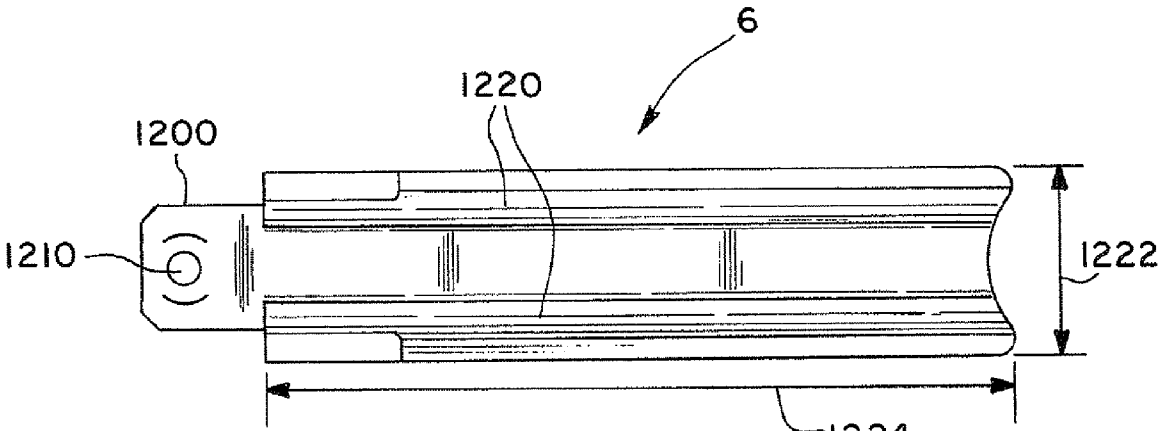
FIGS. 12*a*, 12*b*, and 12*c* are views of a double parasitic UHF antenna element.
Figure 12A:
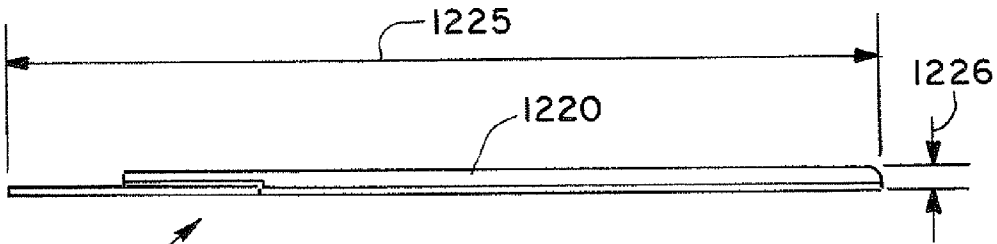
Figure 12C:
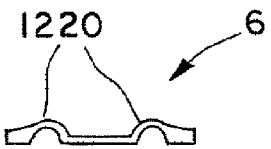

FIGS. 12*a*, 12*b*, and 12*c* show the detail of the UHF antenna elements 6 made from aluminum stock and coated with an iridite finish. The end portion 1200 has a formed hole 1210 which aligns over formed hole 520*a* in boom 2*a* on support 530 so that a rivet 7 firmly secures the element 6 to the boom 2*a* through holes 1210 and 520*a*. The shape of the antenna element 5 can be of any suitable shape to act as a parasitic UHF antenna. The shape shown is aerodynamic and is provided with raised ridges 1220 that provide strength in wind and vibration. Dimensions for the embodiment shown are: length 1222 is 1.08 inches, length 1224 is 5.30 inches, length 1225 is 6.00 inches, and length 1226 is 0.13 inches.

It is to be understood that any parasitic element design can be utilized herein such as wire or printed conductive material, etc. other than the metal stampings shown in FIGS. 11 and 12. In addition the single boom extension can be any suitable mechanical structure extending from antenna 1 to hold the parasitic elements 5 and 6. By way of example a mechanical support plane connected to or integral with base 2 extending outwardly could carry printed elements 5 and 6. Any suitable parasitic element design could be mounted on the boom 2*a* or could be mounted to the base 2.

Figure 13A:
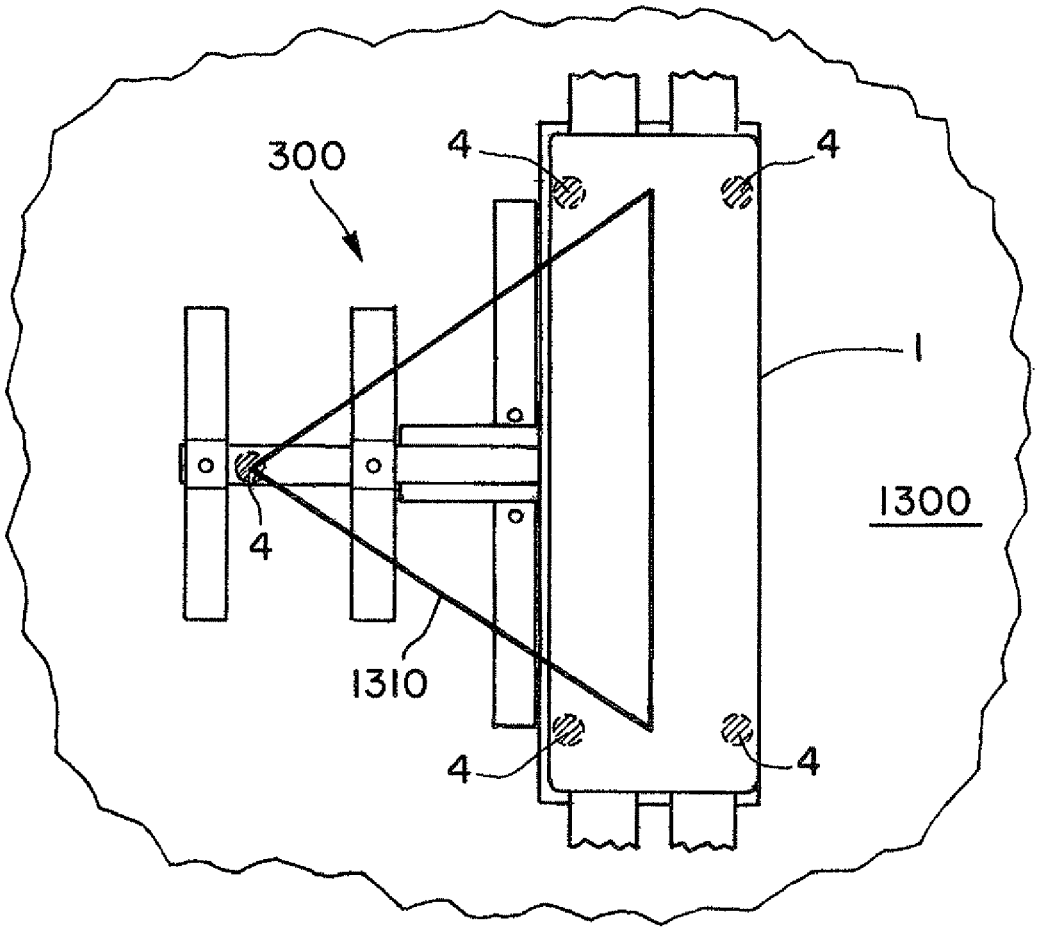
FIGS. 13*a* and 13*b* illustrate the stowing of the combined mobile television antenna and UHF parasitic antenna.
Figure 13B:
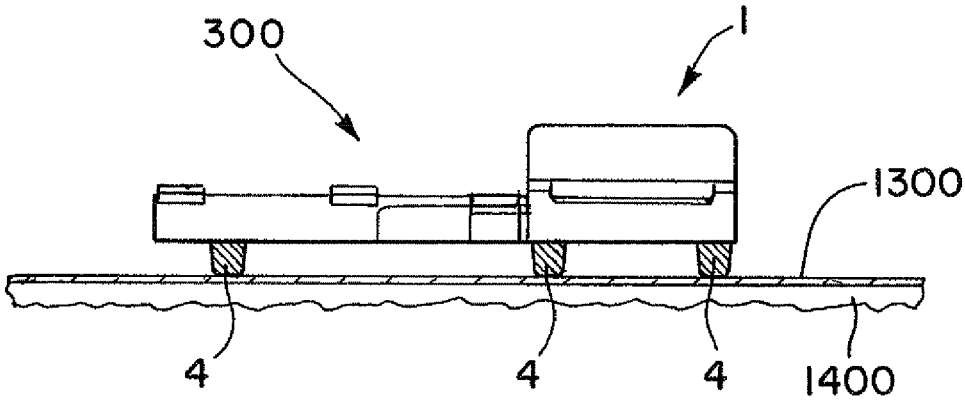

FIGS. 13*a* and 13*b* illustrate the stowing of the installed kit 300 and the mobile antenna 1 against the roof 1300 of a vehicle 1400. The five resilient feet 4 provide a triangular stow force 1310. The five feet 4 stabilize the combined mobile television antenna 1 with the installed kit 300 on the roof 1300 in high wind loads and against vehicle vibration during travelling. More or less than five feet 4 could be utilized. However, three feet 4 are required to provide the triangular stow force.

The aftermarket kit 300, shown in FIGS. 3 and 4, is provided to the operator with the parasitic elements 5 and 6 riveted to the boom 2*a* with all resilient feet 4 inserted. The user takes this assembly along with the separately provided push rivets 3 and then follows the aforesaid presented method of retrofitting as discussed above with respect to FIG. 14.

In summary, a universal aftermarket UHF parasitic antenna kit is set forth as an operational addition to more than one type of mobile television antenna. The aftermarket kit includes: a base having an engagement surface and an extending integral boom portion; a number of formed rivet holes in the engagement surface of the base that correspond in size and location to at least one pattern of a corresponding number of formed holes in the bottom of the mobile television antenna; push rivets that are pushed-in to engage the formed rivet holes and the formed bottom holes to firmly hold the base to the bottom of the mobile television antenna. The base has a number of formed base foot mounted resilient base feet for stowing stability and at least one extending UHF parasitic antenna element to boost performance of the mobile television antenna. The kit is universal in that any suitable number of hole patterns can be performed in the engagement surface 510 of the base 2 to correspond to the different types/models of mobile television antennas.

While the above is directed towards use of the UHF parasitic antenna kit for mobile television antennas for use on a vehicle such as an RV, the kit can also be used on such mobile television antennas when used in residential or home environments.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A universal aftermarket ultra high frequency antenna kit as an operational addition to one of a plurality of different types of mobile television antennas, each of said plurality of different types of mobile television antennas having a bottom with a pattern of holes for receiving resilient feet, said kit comprising:

a base, said base having an engagement surface and an extending boom portion;

a plurality of formed rivet hole patterns in said engagement surface corresponding in size and location to at least some of said bottom hole patterns for said plurality of different types of mobile television antennas;

a number of push rivets, said number of push rivets engaging formed rivet holes in the rivet hole pattern corresponding to the bottom hole pattern of one of said plurality of different types of mobile television antennas, when said resilient feet are removed, to firmly hold said base to the bottom of the aforesaid one mobile television antenna;

an ultra high frequency parasitic antenna element connected to said extending boom portion.

2. The universal aftermarket ultra high frequency antenna kit of claim 1 wherein said extending boom portion is integral with said base.

3. The universal aftermarket ultra high frequency antenna kit of claim 1 wherein said base further includes three side walls around said engagement surface forming a retention cavity to hold said bottom of said mobile television antenna.

4. The universal aftermarket ultra high frequency antenna kit of claim 1 wherein said engagement surface corresponds to the size of said bottom.

5. The universal aftermarket ultra high frequency antenna kit of claim 1 wherein said ultra high frequency parasitic antenna comprises at least one ultra high frequency parasitic antenna element connected to said boom.

6. The universal aftermarket ultra high frequency antenna kit of claim 5 wherein said at least one ultra high frequency parasitic antenna element has at least one raised rib providing strength in wind and vibration.

7. The universal aftermarket ultra high frequency antenna kit of claim 1 wherein said ultra high frequency parasitic antenna comprises three spaced ultra high frequency parasitic antenna elements connected to said boom.

8. In a mobile television antenna having a bottom with a plurality of resilient feet for stowing against the roof of a vehicle, the combination with said mobile television antenna of:

a base, said base having an engagement surface configured to said bottom of said mobile television antenna, said base having an extending boom;

a plurality of formed rivet holes in said engagement surface of said base corresponding in size and location to a corresponding plurality of formed holes in said bottom when said plurality of resilient feet are removed from said bottom;

a plurality of push rivets, said plurality of push rivets engaging said plurality of formed rivet holes and said plurality of bottom holes to firmly hold said base to said bottom of said mobile television antenna;

a plurality of formed foot holes in said engagement surface and said bottom of said base;

a plurality of resilient base feet engaging said plurality of formed foot holes for stowing against said roof of said vehicle;

an ultra high frequency parasitic antenna connected to said boom.

9. The combination of claim 8 wherein said base further includes a plurality of side walls around said engagement surface forming a retention cavity to hold said bottom of said mobile television antenna.

10. The combination of claim 9 wherein said plurality of resilient base feet form a triangular shape between said engagement surface and said boom stabilizing said combination when stored against said roof.

11. The combination of claim 8 wherein said ultra high frequency parasitic antenna comprises at least one ultra high frequency parasitic antenna element connected to said boom.

12. The combination of claim 11 wherein said ultra high frequency parasitic antenna comprises three spaced ultra high frequency antenna elements connected to said boom.

13. A method for retrofitting an ultra high frequency parasitic antenna to operate with a mobile television antenna comprising:

removing resilient feet from foot holes in a bottom of said mobile television antenna;

aligning formed rivet holes in a base of said ultra high frequency parasitic antenna over said formed foot holes in said bottom of the mobile television antenna;

inserting rivets into said aligned formed rivet and foot holes to attach said base of said ultra high frequency parasitic antenna to the mobile television antenna, said attached base holding said ultra high frequency parasitic antenna to increase ultra high frequency performance of said mobile television antenna.

* * * * *